US005564549A

United States Patent [19]

Menke et al.

[11] Patent Number: 5,564,549

[45] Date of Patent: Oct. 15, 1996

[54] SWITCH FOR THE DISTRIBUTION OF COINS

[75] Inventors: Wilhelm Menke, Ingelheim am Rhein; Börge Heidersbeger, Bingen am Rhein, both of Germany

[73] Assignee: NSM Aktiengesellschaft, Bingen am Rhein, Germany

[21] Appl. No.: 308,732

[22] Filed: Sep. 19, 1994

[30] Foreign Application Priority Data

Sep. 23, 1993 [DE] Germany ..... 43 32 400.2

[51] Int. Cl.[6] ..... G07D 3/14

[52] U.S. Cl. ..... 194/346; 453/3

[58] Field of Search ..... 194/346; 453/3, 453/5, 9, 15

[56] References Cited

U.S. PATENT DOCUMENTS

| | | | |
|---|---|---|---|
| 3,200,828 | 8/1965 | Offutt et al. | 194/346 X |
| 4,838,406 | 6/1989 | Levasseur | 194/346 |
| 4,901,838 | 2/1990 | Crossman | 194/317 X |
| 5,040,658 | 8/1991 | Levasseur | 194/346 |
| 5,167,314 | 12/1992 | Levasseur | 194/346 |

FOREIGN PATENT DOCUMENTS

| | | | |
|---|---|---|---|
| 625214 | 2/1936 | Germany | 194/346 |
| 3718979 | 12/1988 | Germany | 453/3 |

*Primary Examiner*—F. J. Bartuska
*Attorney, Agent, or Firm*—Dilworth & Barrese

[57] ABSTRACT

A switch for the distribution of coins standing on edge and moving through a coin passage among three routing passages possesses a coin switch tongue adapted to pivot about a lower axis and whose end surface in a first position closes the floor of the coin passage and in a second position uncovers a gap in the floor which constitutes an inlet opening to two coin routing passages. In order to provide a coin switch of the sort noted initially which owing to having completely regular and reproducible positioning of the coin switch tongue is responsible for a reliable distribution of the coins from a supply passage, among three routing passages a second coin switch tongue is pivoted for movement around an axis coinciding or parallel to the said axis of the first coin switch tongue, which second coin switch tongue is able to be switched over between a left and right position, in which it respectively gives access to one of the routing coin passages.

12 Claims, 8 Drawing Sheets

SWITCH FOR THE DISTRIBUTION OF COINS

BACKGROUND OF THE INVENTION

The invention relates to a switch for the distribution of coins standing on edge and moving through a coin passage among three routing passages comprising a coin switch tongue adapted to pivot about a bottom axis and whose end surface in a first position closes the floor of the coin passage and in a second position uncovers a gap in the floor which constitutes an inlet opening to two coin routing passages.

In a coin switch of this type disclosed in the U.S. Pat. No. 5,167,314 the the switch tongue possesses three switching settings, of which the middle one closes the gap in the floor for free passage therethrough of the coins and the two other settings between the left and, respectively, right side of the coin switch tongue and lateral delimiting walls constitute inlet points to routing coin passages. The known apparatus requires an extremely exact control of the coin switch tongue by an actuator in order to ensure a reliable distribution of the coins among the three possible paths. In the case of the known apparatus trouble conditions are very likely to occur, if the actuator does not exactly set into the middle position, which corresponds to free passage.

Accordingly one object of the invention is consequently to provide a coin switch of the sort noted initially which owing to having completely regular and reproducible positioning of the coin switch tongue is responsible for a reliable distribution of the coins from a supply passage among three routing passages.

SUMMARY OF THE INVENTION

In accordance with the invention this object is to be attained in the case of a coin switch of the type in question since a second coin switch tongue is pivoted for movement around an axis coinciding with or parallel to the said axis of the first coin switch tongue, which second coin switch tongue is able to be switched over between a left and right position, in which it respectively gives access to one of the two routing coin passages. By means of the two coin switch tongues the coin switch in accordance with the invention may be reliably set to respectively one of the three routing paths, since each coin switch tongue in each switching position may assume but two positions, which are respectively limit or terminal positions as set by abutments. Accordingly no coin switch tongue may assume a middle position, in which it would possibly not operate reliably and accurately.

It is convenient if the first coin switch tongue is provided at its end with an angled part, which in the run-through or open position essentially shuts off the floor of the coin passage.

In keeping with yet another possible form of the invention both coin switch tongues are pivotally mounted on a common axis, and the first coin switch tongue is provided with limbs bent in a U-like configuration, such limbs being provided with holes for pivotally mounting the same on a shaft constituting the common axis.

Each of the two coin switch tongues is provided with actuators for the two respective coin switching positions thereof.

In accordance with a still further possible development of the invention the coin passage constitutes an oblique guide, which is placed underneath a first guide passage extending obliquely upward and which is furnished with a coin test unit, adapted to test the genuineness of coin moving along it and to produce signals corresponding to the significance of coins recognized as being genuine. It is in this manner that the invention provides a run-through coin tester, which in a compact fashion combines a coin test unit with a coin conveying means, which control the passage therethrough and the distribution of the tested coins among routing passages. In the case of the run-through coin tester in accordance with the invention the coin test unit is arranged in a lateral wall of the first oblique guide means and can ascertain the diameter of the coins passing therethrough using optocouplers or reflection photoelectric detectors and furthermore the type of lamination of the coins and the components of the material thereof by inductance measurements. Then for each coin passing along the oblique guide the coin test unit produces a signal, which corresponds to the significance of the coin, providing that the coin has been recognized as being genuine. If it is not possible to identify a coin, then either no signal is produced or a one is produced indicating that the respective coin is not able to be identified, that is to say is for example not genuine. Then according to the output signal the coin switch tongues provided for the the second oblique guide are set, the second oblique guide in this respect consisting of the obliquely set end surfaces of the coin switch tongues, which in the inactive position thereof constitute an oblique guide path for the coins. If in accordance with such control of a coin switch tongue by the coin test unit the tongue is activated, it will then by being pivoted provide access into the respective routing passage.

BRIEF DESCRIPTION OF THE DRAWINGS

One embodiment of the invention will now be described in the following with reference to the accompanying drawings.

DESCRIPTION THE PREFERRED EMBODIMENTS

The entire coin processing system is compactly accommodated in a housing, not illustrated, of a coin in-the-slot gambling machine. The coins are inserted in a slot 6, which may for example be placed in an upper ledge on the front side of the housing of the gambling machine.

After the coins have been inserted in the slot, not illustrated, in the housing of the gambling machine, they pass through a coin passage as far as inlet slot 6 of the run-through coin tester 5.

Figure 1:
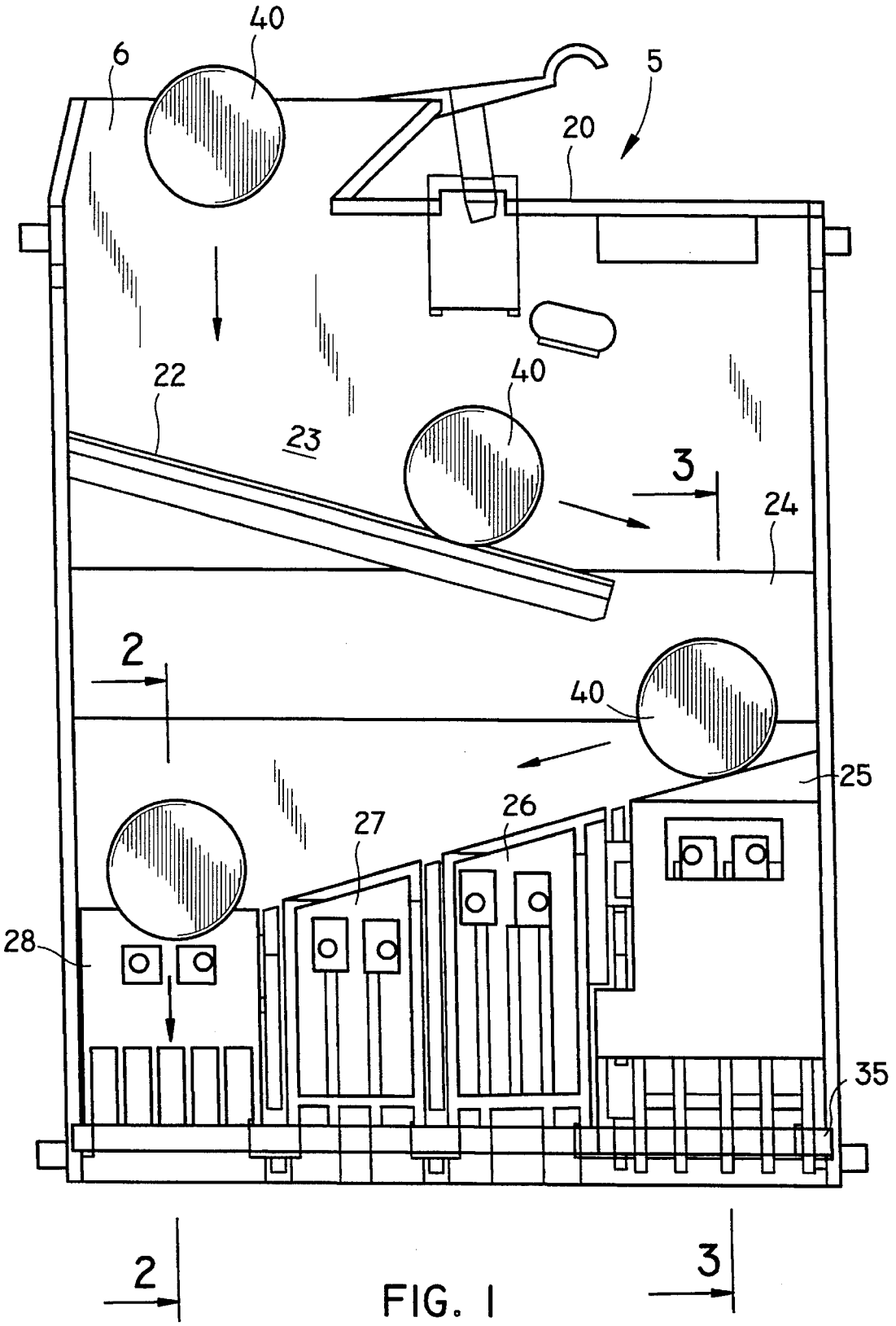
FIG. 1 is a front view of the run-through coin tester, arranged in a housing, with coin conveying means.
Figure 8:
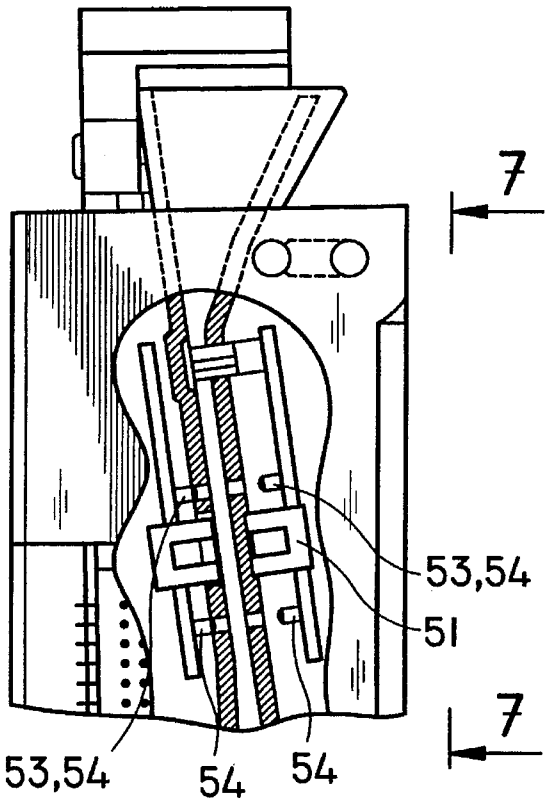
FIG. 8 is a section taken through the inlet part in accordance with FIG. 7.
Figure 7:
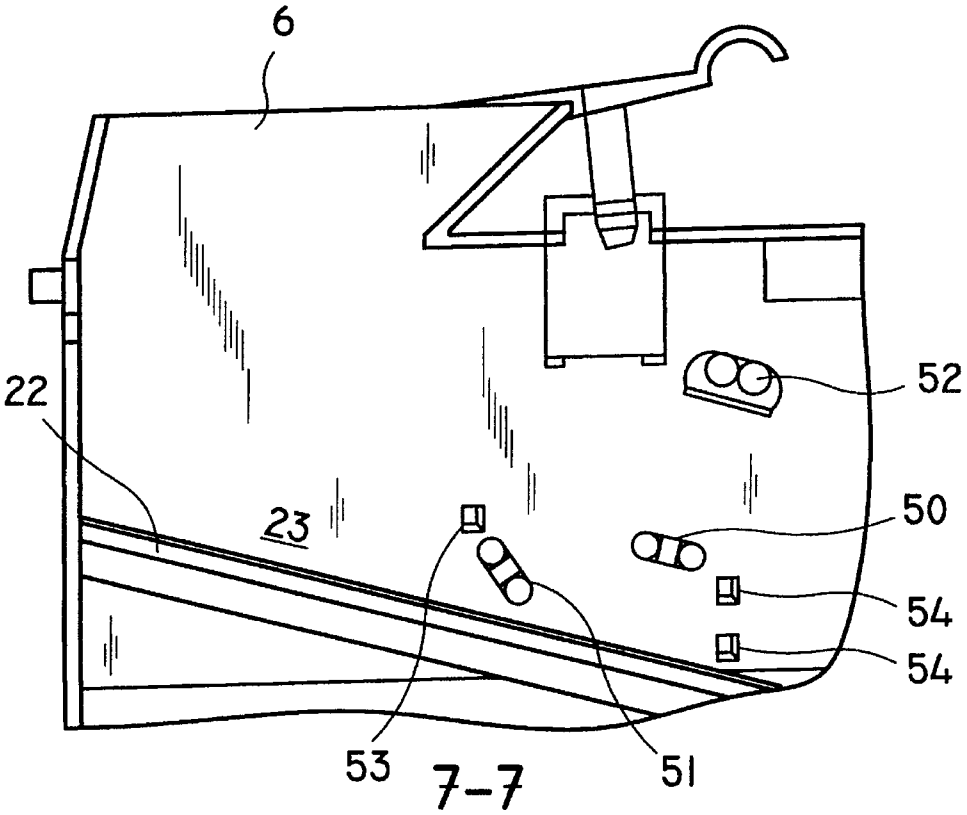
FIG. 7 is view in the direction of arrow 7 in FIG. 8 infra and on a larger scale of part of the coin tester of FIG. 6 showing the coin inlet part with the initial part of the first oblique guide.

The run-through coin tester 5 with a coin conveying and coin distributing device, comprises a flat, rectangular block-like housing with standard dimensions (a width of 5 inches). In the upper wall 20 of the housing the coin slot 6 is located on the left side in terms of FIG. 1. Underneath the inlet slot 6 there is a metallic rail serving for damping, which is adjoined by a guide rail 22 having the same slope and which constitutes the floor of the oblique guide passage 23 for the inserted coins. A coin test unit is accommodated in the housing tests the coins passing through on the oblique guide 23 for genuineness and produces signals for the significance or value of the coins recognized as being genuine, such signals being processed by the system controller, for example for the control of the coin switch tongues to be described in the following. As shown in FIGS. 7 and 8, the detecting elements of the coin test unit comprise electromagnets 50, 51 and 52 serving for inductive determination of the genuineness of the coins, and furthermore photoelectric detectors 53 and 54 with which the diameter of the coins moving through the device can be ascertained.

On either side of the rail-like oblique guide 22 housing walls are provided so that the inserted coins will run along the oblique passage 23 standing upright.

At the end of the oblique passage 23 the coins drop through a slot 24 onto a lower oblique guide which slopes in the opposite direction and which is constituted by the obliquely set terminal surfaces of the coin switch tongues 25, 26 and 27 located in their inactive positions. At the end of this second oblique guide 25 through 27 there is a free-fall downward passage, to which access is permitted by the coin switch tongue 28 when it is in its inactive position.

Figure 5:
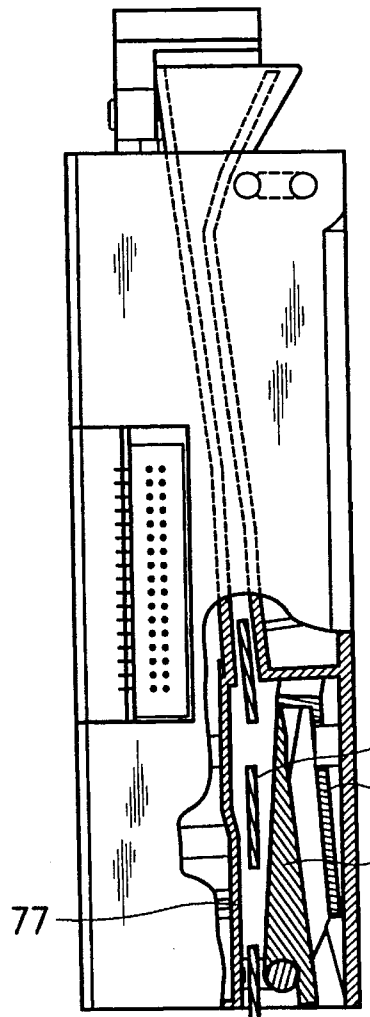
FIGS. 3 through 5 show a lateral elevation of the run-through coin tester according to FIG. 1, partly sectioned on the line 3—3 of FIG. 1 showing various different settings of the coin switch tongue.
Figure 4:
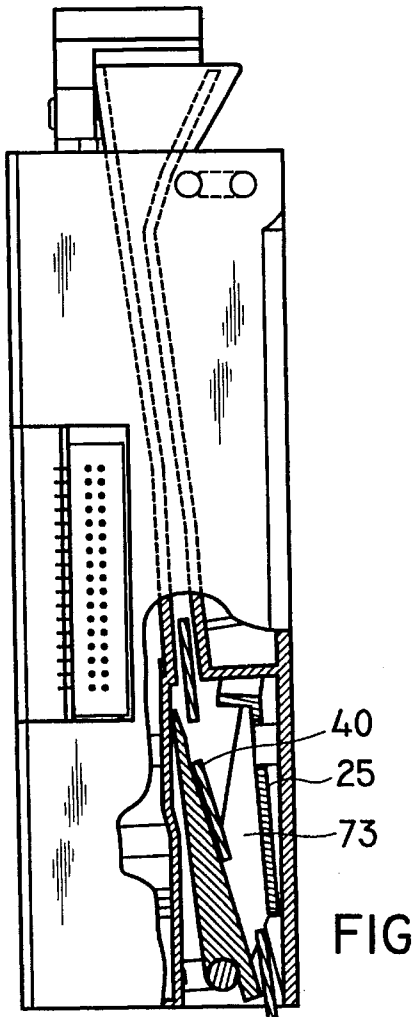
Figure 3:
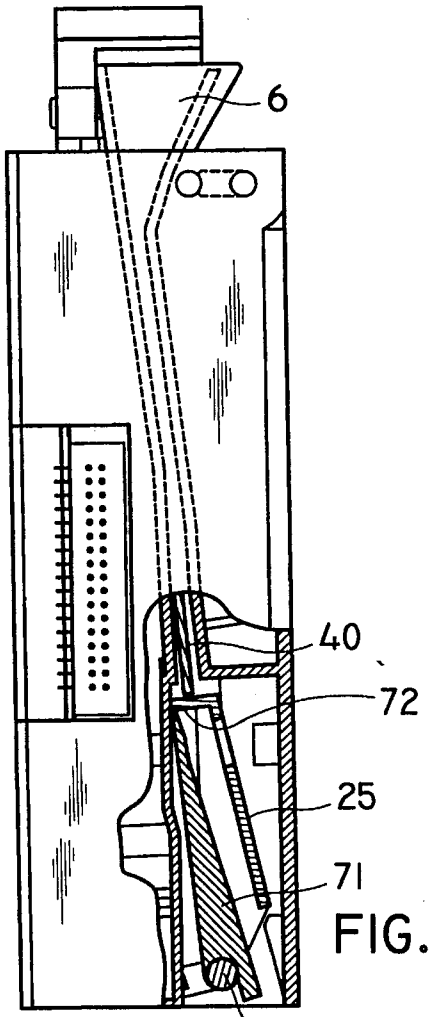

The coin switch tongues 26 through 28 each possess two coin switching positions, which are set by the pivoted armature magnets (not illustrated). As shown in FIGS. 3 through 5, the first coin switch arranged underneath the gap 24 and which is adapted to distribute the coins among three routing paths, comprises two coin switch tongues 25 and 71, which are pivotally mounted on a common bottom or lower shaft 35. Each switch tongue 25 and 71 is provided with actuator means for setting the same in respectively two switching positions. Such switching means are shown, e.g., in U.S. Pat. Nos. 4,838,406; 5,040,658; and 5,167,314, the contents of which are incorporated by reference herein. At its free end the coin switch tongue 25 possesses an angled part 72, which in its left coin switching position indicated in FIG. 3 closes the floor of the lower obliquely extending guide passage. The coin switch tongue 25 possesses bent limbs 73 to the side of its back, such limbs being provided with aligned holes for pivotally mounting the coin switch tongue 25 on the common shaft 35.

On the shaft 35 the second coin switch tongue 71 is also pivotally mounted, it being in the form of a wedge and extending upward to a point. The second coin switch tongue 71 is it is pivotally mounted between the limbs 73 of the coin switch tongue 25. If the coin switch tongue 25 is in its right terminal position as shown in FIGS. 4 and 5, it is possible for the coins 40 to enter the gap then opened up in the floor. In the right terminal position of the coin switch tongue 25 it is possible for the second coin switch tongue 71 to assume a left terminal position, which is indicated in FIG. 4 and a right terminal position, which is depicted in FIG. 5. In the two terminal positions indicated FIGS. 4 and 5 of the coin switch tongue 71 the same provides access for the coins 40 to routing passages, which are indicated by arrows 75 and 76. In this respect the path 75 is defined by the right side of the coin switch tongue 71 and the left side of the coin switch tongue 25 whereas the path 76 is between the left side of the coin switch tongue 71 and the adjoining housing partition 77.

In their inactive position the coin switch tongues 26 and 27 also close the second oblique guide. If there are activated then they are pivoted out from the plane of the drawing as it were so that they enable access to the 1 DM and 2 DM coin stack tubes. The corresponding pivoting action takes place on operation of pivoted armature magnets.

In its inactive position of the pivoted armature magnet the coin switch tongue 28 frees access to the passage leading to the return plate, while the activated pivoted armature magnet so pivots the coin switch tongue 28 out from the plane of the drawing that access to the 5 DM stack tube is possible.

Figure 2:
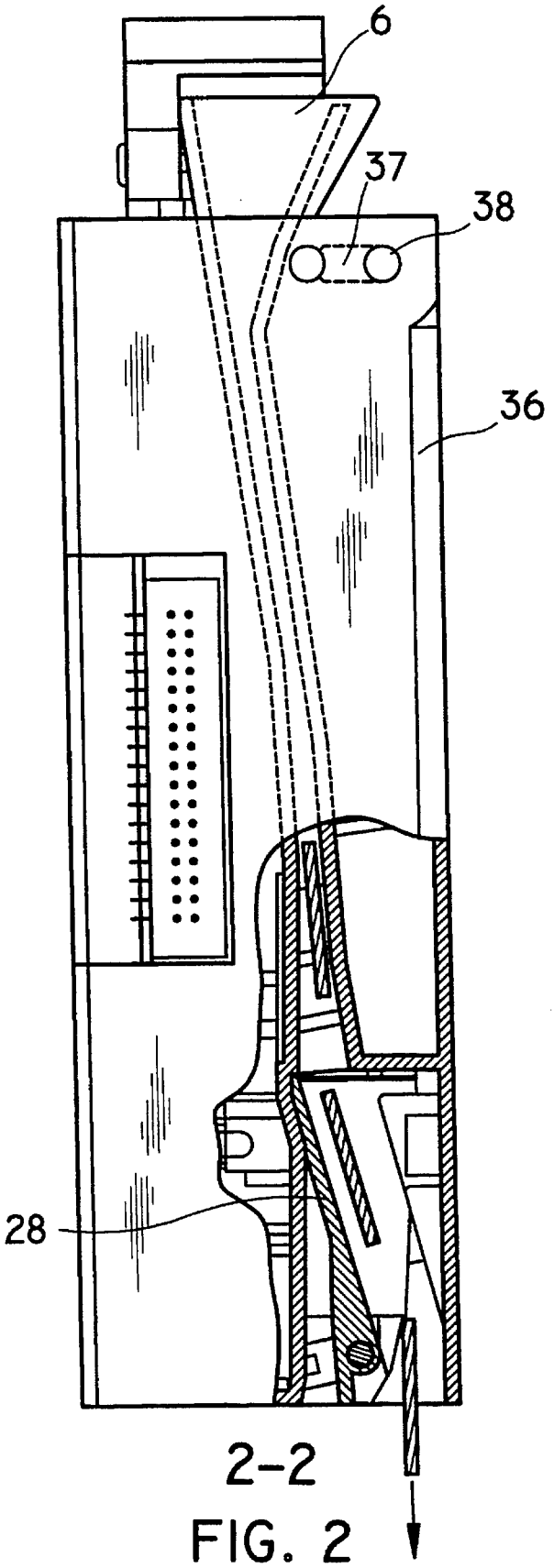
FIG. 2 is a lateral elevation of the run-through coin tester in accordance with FIG. 1 partly sectioned on the line 2—2 of FIG. 1.
Figure 6:
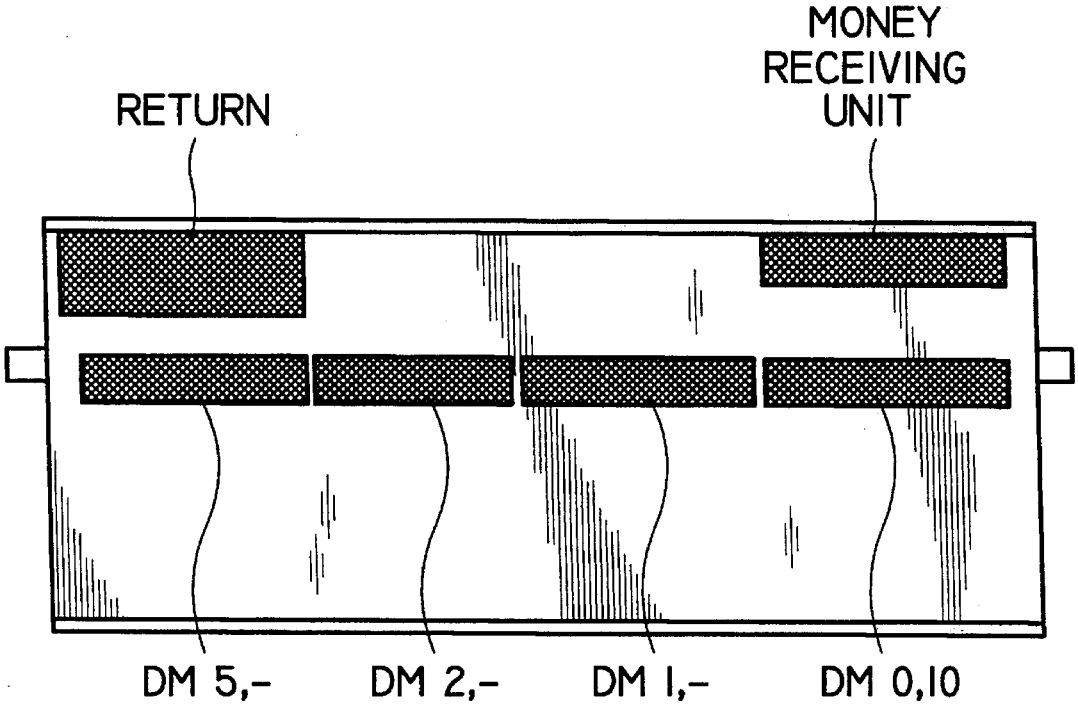
FIG. 6 is view from below of the coin tester of FIGS. 1 through 5.

The coin switch tongues 25 through 28 are pivotally mounted on the common lower shaft 35, The housing is closed by a front housing cover 36 constituting the front wall of the oblique guides, such cover 36 being pivotally mounted on the shaft 38, which is mounted in the side walls of the housing, by means of a slot 37. The housing cover is so supported on the shaft 38 by means of a strip spring that the shaft 38 is at the right end (in terms of figure 2) in the slot. By depressing the spring and sliding in the slots 37 on the shaft 38 the cover 36 can be lifted to a limited extent from the housing so that any coins jammed in the oblique guides may be unjammed and removed. In order to be able to cope with jams automatically, it is possible to provide a motor-driven device, by means of which the cover may be lifted by sliding the shaft 38 in the slots 37 and which may comprise an electric motor and a plunger serving for actuation, a transmission with gearing possibly being possible as well, which for example comprises a worm, a worm wheel and a cam actuating the plunger or ram, FIG. 6 shows a view from below of the housing of the run-through coin tester 5, the respective outlet slots, to which access is provided by the coin switch tongues being represented as short black bars.

Figure 9:
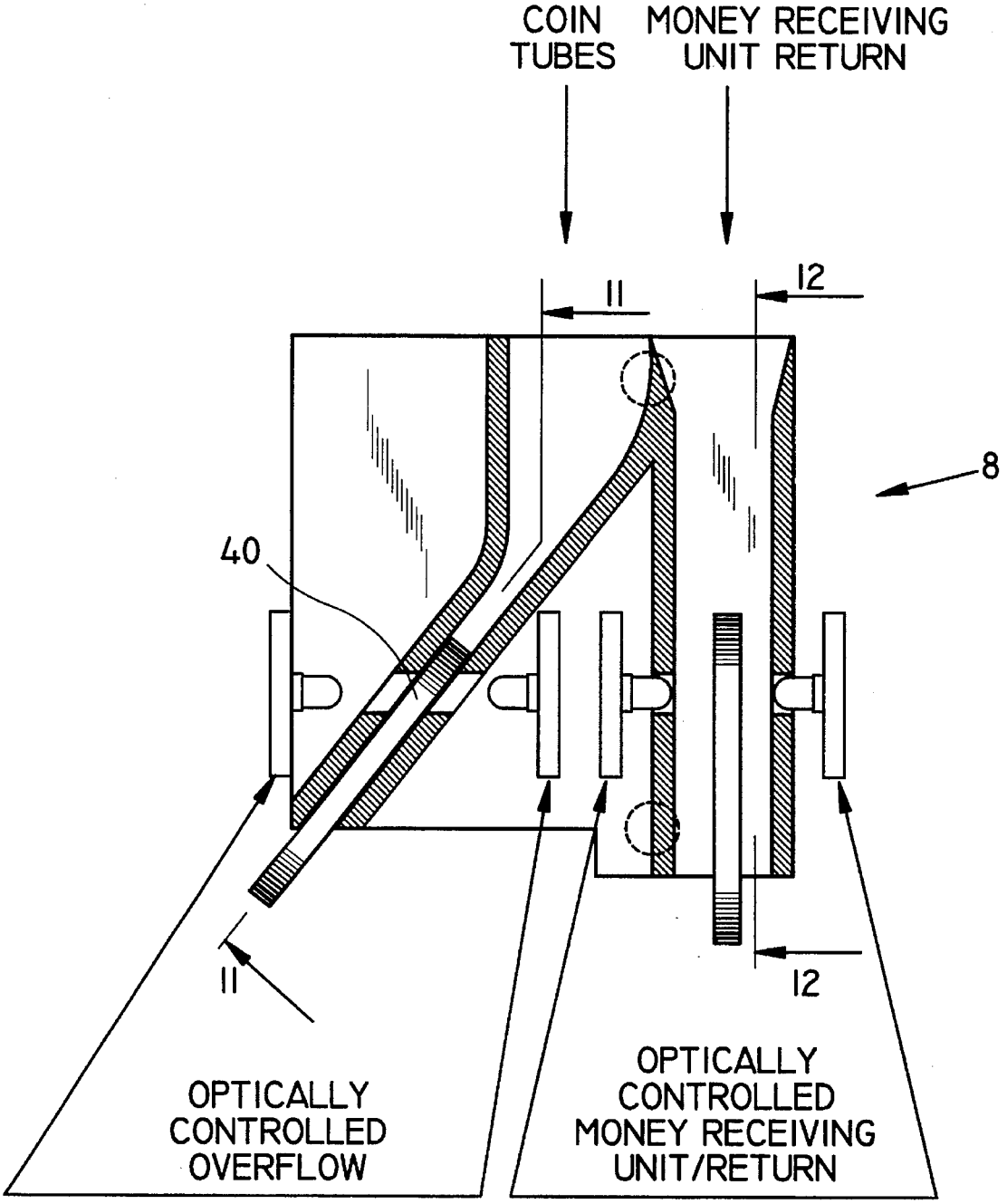
FIG. 9 is a cross section taken through a coin run-through adapter.
Figure 10:
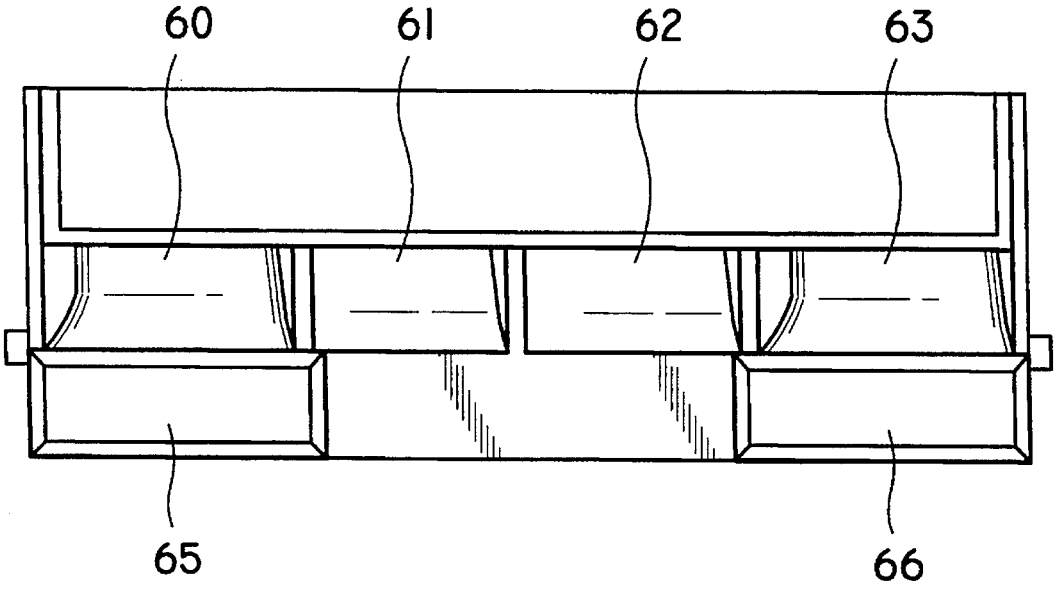
FIG. 10 is a view from below of the coin run-through adapter in accordance with FIG. 9.

With reference to FIGS. 9 through 12 a description will now be given of the coin run-through adapter 8. The coin run-through adapter comprises a molded synthetic resin component with passages arranged adjacent to one another for the routing or, respectively, distribution of the coins emerging from the run-through coin tester. In FIG. 10 the reader will perceive a plan view of the run-through coin adapter. In the upper row the same possesses four adjacently placed inlet openings 60 through 63, through which the inserted coins are passed to the coin stack tubes. In this respect the 5 DM coins will go into the opening 60, the 2 DM coins into the opening 61, the 1DM coins into the opening 62 and the 10 penny coins into the opening 63.

In the row underneath this the inlet openings 65 and 66 at the end are provided, which lead to the coin return point and, respectively, collecting containers. The inlet openings illustrated in FIG. 10 are in alignment with the outlet slots, depicted in FIG. 6, of the housing of the coin runthrough tester.

Figure 11:
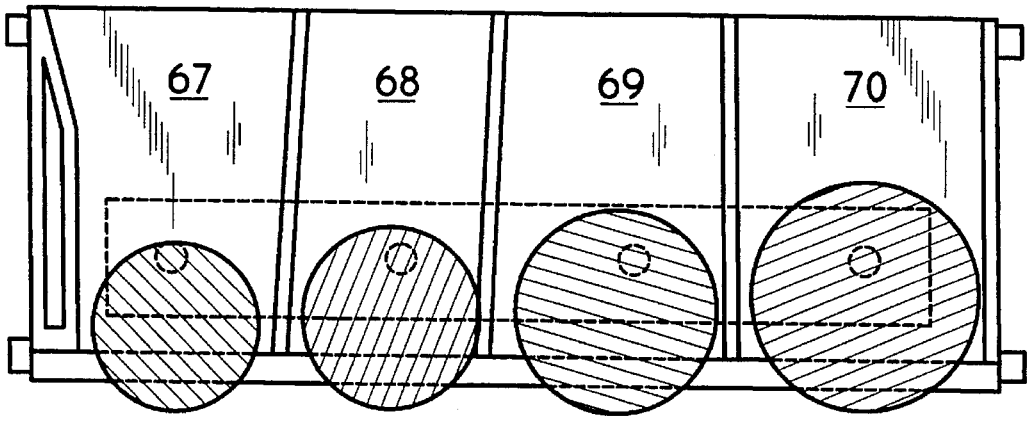
FIG. 11 is a section taken through the coin run-through adapter taken on the line 11—11 of FIG. 9.

In FIG. 11 the reader will see a section taken on the line 11—11 of FIG. 9, which shows a distribution passages 67 through 70 leading to the coin stack tubes. These distribution passages are made oblique in the fashion indicated in FIG. 9.

Figure 12:
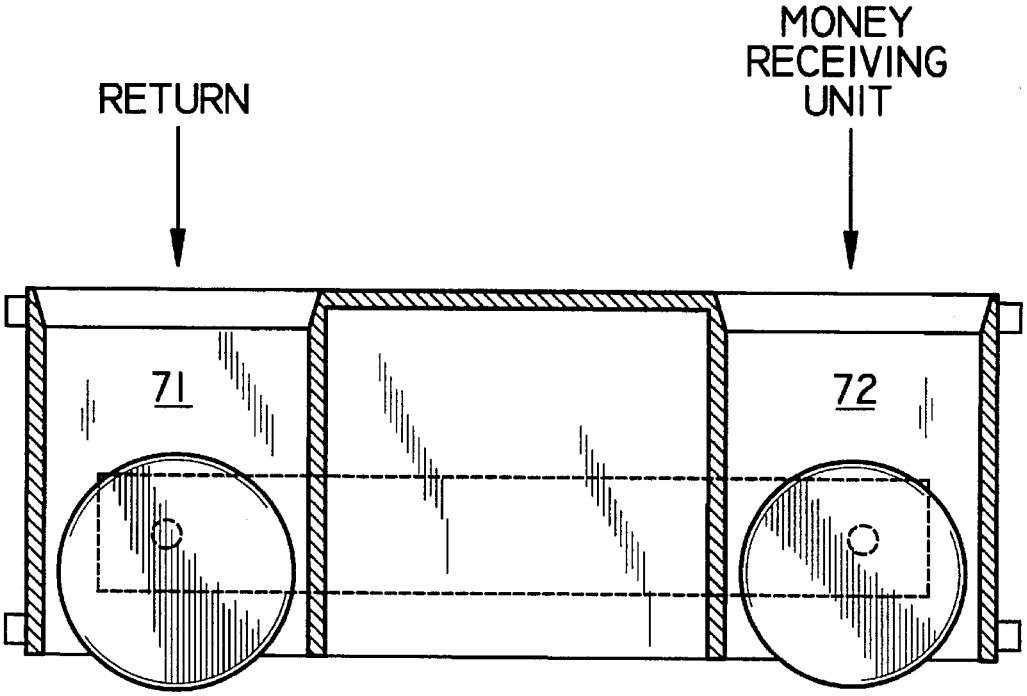
FIG. 12 shows a section taken through the coin run-through adapter on the line 12—12 of FIG. 9.

The FIG. 12 shows a section taken on the line 12—12 of FIG. 9. The passages 71 and 72 leading edge to the coin return point and to the collecting container extend in a vertical direction through the run-through coin adapter 8 in the manner indicated in FIG. 9.

In the passages 67 through 72 photoelectric detectors are arranged in the fashion indicated in FIGS. 9 through 12 in the aligned holes, such detectors providing signals each time a coin passes or, respectively, remaining obscured, if for example after a coin stack tube is full a coin 40 remains in one of the passages 67 through 70.

We claim:

1. A switch for the distribution of coins standing on edge and moving through a coin conveying passage, comprising:

a) a first coin switch tongue (25) adapted to pivot about a bottom axis (35) and having an end surface which, in a first position, closes by means of an angle part (72) a running surface of said coin passage and, in a second position, uncovers a gap in the running surface which constitutes an inlet opening above two coin chutes (75, 76), and b) a second coin switch tongue (71) adapted to pivot about the same axis (35) as said first coin switch tongue (25), whereby said second coin switch tongue is able to be switched over between a left and right position, in which it respectively gives access to one of the two coin chutes (75 and 76), wherein both said switch tongues (25 and 71) are pivotally mounted on the same axis (35).

2. The coin switch as claimed in claim 1, wherein a common shaft (35) constitutes the axis on which both said switch tongues (25 and 71) are pivotally mounted and said first switch tongue (25) is furnished with limbs (73) having a U-shaped configuration and which are provided with holes for pivotally mounting on the common shaft (35).

3. The coin switch as claimed in claim 1, wherein each switch tongue (25 and 71) is provided with actuator means for setting the same in respectively two switching positions.

4. The coin switch as claimed in claim 1, wherein the coin conveying passage constitutes an oblique guide, which is arranged underneath a first oppositely upwardly oblique guide passage (23), which is furnished with a coin test unit (5) adapted to test genuineness of coins (40) passing therethrough and to produce respective signals with respect to coins recognized as being genuine.

5. The coin switch as claimed in claim 4, wherein the running surface of the lower coin conveying passage is constituted by a plurality of first switch tongues (25 through 28) adapted to pivot about lower axes whereby said first switching position closes the running surface for further movement of the coins (40) and said second position opens an inlet of at least one coin chute.

6. The coin switch as claimed in claim 1, wherein said first and second coin switch tongues (25, 71) are formed and disposed to guide movement of a coin through or along one of three routing passages.

7. The coin switch as claimed in claim 6, wherein each said first and second switch tongue (25, 71) may assume only two positions which are respectively limit or terminal positions as set by abutments.

8. The coin switch as claimed in claim 7, wherein said first and second coin switch tongues (25, 71) are formed and disposed such that each said switch tongue (25, 71) cannot assume a middle position.

9. The coin switch as claimed in claim 4, said switch being combined in compact fashion with said coin test unit (5).

10. The coin switch as claimed in claim 5, wherein said switch is formed and arranged such that said coin test unit (5) signals respective ones of said plurality of first switch tongues (25 through 28).

11. The coin switch as claimed in claim 5, comprising three first switch tongues (25, 26, 27).

12. The coin switch as claimed in claim 11, comprising four first switch tongues (25 through 28).

* * * * *